United States Patent [19]

Bell

[11] Patent Number: 4,742,875

[45] Date of Patent: May 10, 1988

[54] MOTOR-DRIVEN HAMMER

[76] Inventor: Joseph P. Bell, Tamiami Village, 52 Plunto Cir., N. Fort Myers, Fla. 33903

[21] Appl. No.: 841,261

[22] Filed: Mar. 19, 1986

[51] Int. Cl.[4] ..... B25D 1/00

[52] U.S. Cl. ..... 173/117; 81/20; 173/121; 173/123

[58] Field of Search ..... 173/117, 123, 133, 116, 173/118, 132, 121; 74/50; 81/20, 25, DIG. 12

[56] References Cited

U.S. PATENT DOCUMENTS

| | | | |
|---|---|---|---|
| 2,113,084 | 4/1938 | Hewitt et al. | 81/20 |
| 2,286,521 | 6/1942 | Walter | 173/123 |
| 2,342,601 | 2/1944 | Pyle | 173/123 |
| 2,703,029 | 3/1955 | Steukers | 173/123 |
| 2,877,820 | 3/1959 | Ristow | 173/123 |
| 3,376,940 | 4/1968 | Willis | 173/117 |

*Primary Examiner*—E. R. Kazenske
*Assistant Examiner*—Hien H. Phan
*Attorney, Agent, or Firm*—Hill, Van Santen, Steadman & Simpson

[57] ABSTRACT

A motor-driven hammer may include an air motor, a DC motor operated from rechargeable batteries, or an AC motor operated from the commerical power supply. In one embodiment, the motor is coupled to reciprocate the hammer head by way of a cam is a tension spring. In the second embodiment a compression spring is employed in conjunction with a cam which releases the hammer head upon full compression of the spring.

11 Claims, 2 Drawing Sheets

FIG. 1
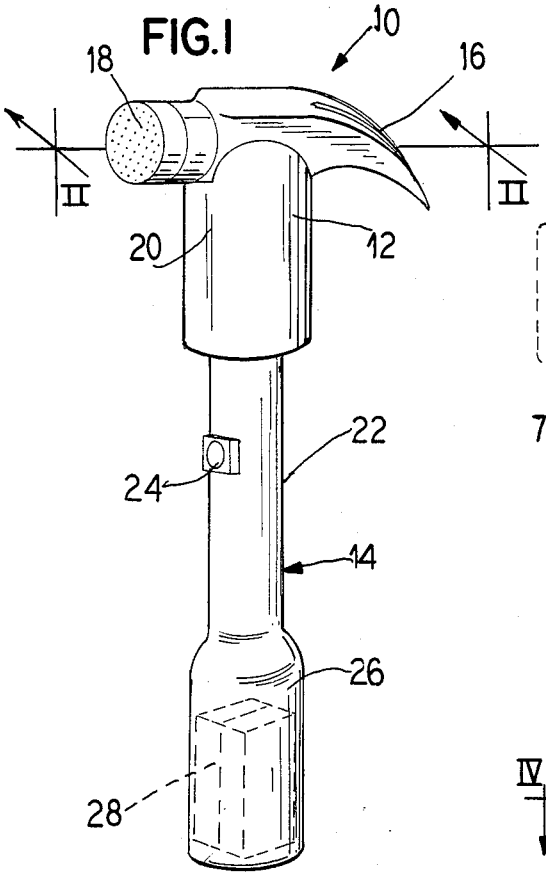
FIG. 3
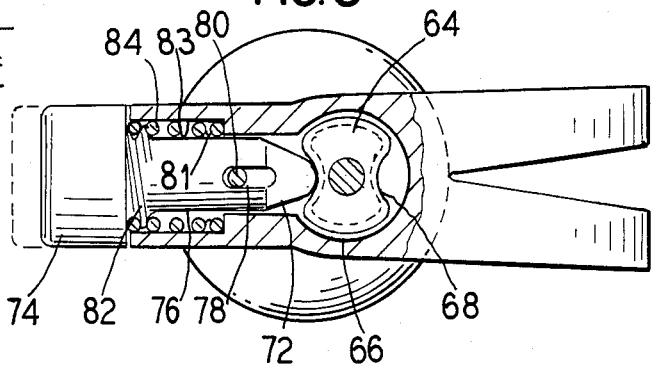
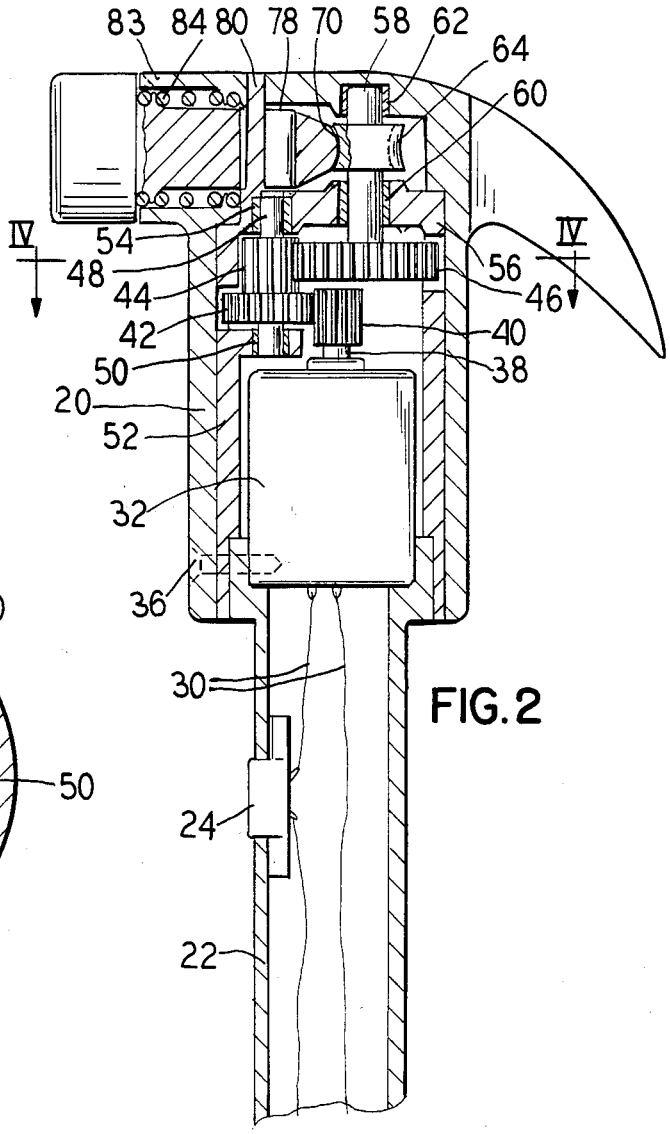
FIG. 2
FIG. 4
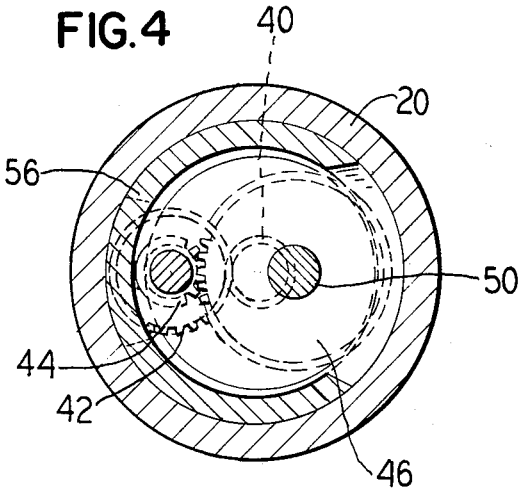

FIG.5
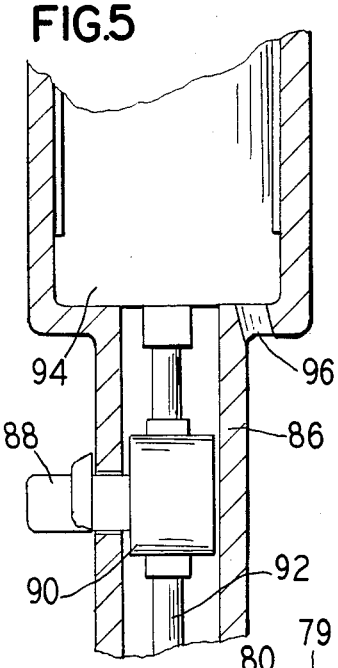
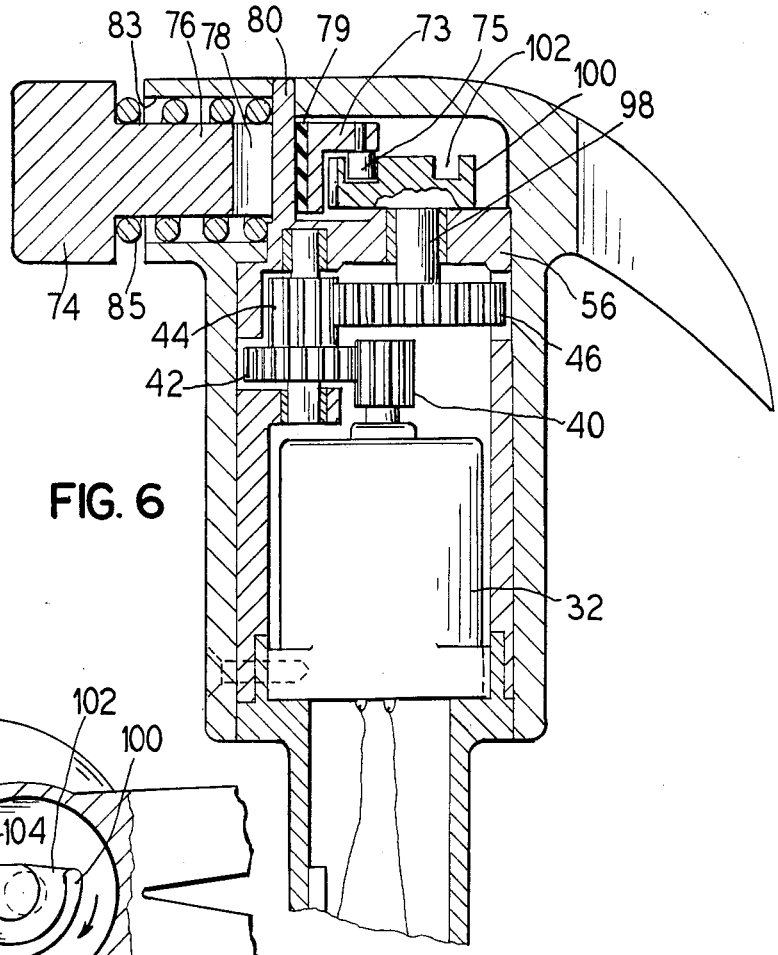
FIG. 6
FIG.7
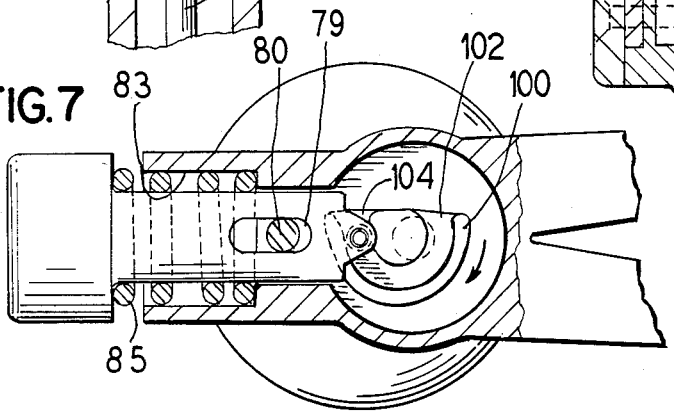
FIG.8
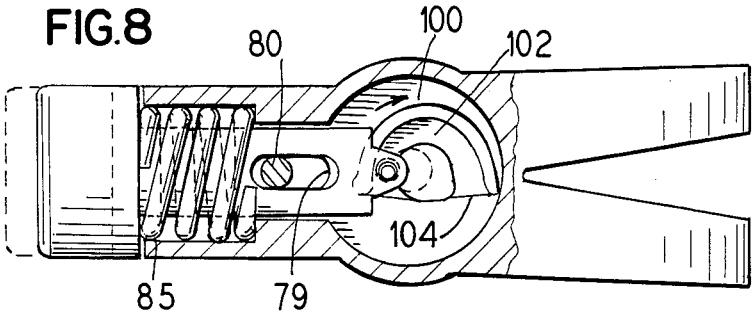

MOTOR-DRIVEN HAMMER

BACKGROUND OF THE INVENTION

1. Field of the Invention

The present invention relates to a hammer, and more particularly to a motor-driven hammer which may include an air motor, a DC motor powered by rechargeable batteries, or an AC motor operated from the commercial power supply.

2. Description of the Prior Art

Many motor-driven hammers are known in the art, including jack hammers and hammers driven by electric motors. These hammers are generally for use in construction, quite heavy and noisy.

SUMMARY OF THE INVENTION

It is the object of the present invention to provide a motor-driven hammer, particularly for home and light industrial applications, in which the hammer has the general shape of the well-known claw hammer, is light weight, and has the striking head driven by a motor via a cam mechanism.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 is a pictorial representation of a hammer constructed in accordance with the present invention;

FIG. 2 is a fragmentary sectional view of the hammer of FIG. 1 taken along the parting line II—II;

FIG. 3 is a top view of the hammer of FIG. 1 shown partially in section;

FIG. 4 is a sectional view taken generally along the parting line IV—IV of FIG. 2;

FIG. 5 is a fragmentary sectional view showing an air motor and a valve for controlling the air motor in a hammer structure of the type illustrated in FIG. 1;

FIG. 6 is a sectional view similar to that of FIG. 2 illustrating a cam arrangement different from that of FIG. 2;

FIG. 7 is a top view of the hammer of FIG. 6, shown partially in section and showing the beginning of the rearward movement of the head in association with the cam structure; and FIG. 8 is a view similar to that of FIG. 7 showing the head in its fully retracted position, in association with the cam structure.

DESCRIPTION OF THE PREFERRED EMBODIMENTS

Referring to FIG. 1 a hammer is generally illustrated at 10 as comprising a head section 12 and a handle section 14. The head section 12 is shown as comprising a nail-pulling claw 16 and a striking head 18. The head section 12 also comprises a motor housing 20 integral with the claw 16.

The handle section 14 is illustrated as comprising a tubular member 22 to be grasped by a hand and mounting an actuating switch 24. An enlarged tubular section is integral with the tubular member 22 and is shown as housing rechargeable batteries 28.

Referring to FIG. 2, the tubular member 22 is illustrated as connected to the motor housing 20. A pair of conductors 30 are connected to a motor 32 which is controlled by the switch 24 interposed in at least one of the conductors. The motor 32 is mounted in a recess in the upper end 34 of the tubular member 22 and secured by screws 36 (only one shown).

The motor 32 includes an output shaft 38 carrying a gear 40 which is meshed with a gear 42. The gear 42 is carried on a shaft 48 for rotation with a gear 44 which is meshed with a gear 46. The shaft 48 is journaled for rotation in a pair of bearings 50 and 54 mounted in a tubular member 52 and an end member 56. The gear 46 is carried on a shaft 58 which is journaled for rotation in a bearing 60 in the member 56 and in a bearing 62 in the upper end of the head section 12.

The shaft 58 carries a cam 64 which, as best seen in FIG. 3, comprises a pair of opposed lobes 66 separated by a pair of opposed recesses 68. The cam 64 also includes a peripheral groove 70 which receives a complementary-shaped member 72 which is connected to the hammer head 74 by way of an intermediate member 76. Adjacent the head 74 is a cavity 83 which receives the intermediate member 76. The intermediate member 76 is provided with a thread 82 and a tension spring 84 is screwed onto the intermediate section 76 and onto a thread 81 within the cavity 83.

As is apparent, the lobes 66 cam the members 72, 76, 74 outwardly to apply tension to the spring 84 and the recesses 68 permit the spring 84 to return the head towards the rear.

As best seen in FIGS. 2 and 3, the intermediate section 76 includes an elongate aperture 78 for receiving a guide pin 80 which projects from the member 56 so that the head 74 reciprocates along a straight line. Turning to FIG. 5, a variation is illustrated in which the handle includes a tubular member 86 having an actuating button 88 extending therethrough for operating a valve 90 within the handle which is connected in a compressed air line 92. The valve 90 delivers compressed air for operating an air motor 94 having an exhaust port 96. In this embodiment, the cam structure of FIGS. 2 and 3 or the cam structure to be discussed below with respect to FIGS. 6–8 may be employed.

FIGS. 6–8 illustrate a preferred embodiment of the invention in which the shaft 58 of FIG. 2 has been replaced by a shorter shaft 98 carrying a cam 100 which includes a cam groove 102 for receiving a cam follower 75 therein. In this embodiment, the member 72 has been replaced by a member 73 which rotatably supports the cam follower 75. Also, the elongate aperture 78 is provided with a resilient member 79 to soften the blow against the guide pin 80. In addition, a compression spring 85 is mounted over the intermediate member 76 and bears against the head 74 and the opposite end of the chamber 83.

As best seen in FIGS. 7 and 8, the cam track 102 includes a bell-shaped leading edge which, upon rotation, receivesand guides the cam follower 75 into the groove 102. As shown in FIG. 7 as the cam 100 rotates in the direction of the arrow, the head will be drawn toward the rear until such time as the spring 85 is fully compressed, as illustrated in FIG. 8. Rotation of the cam 100 past the position illustrated in FIG. 8 releases the cam follower 75 and releases the spring 85 to drive the head forward and thus provide the striking force.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A hand-held hammer comprising:

a head section and a hammer head mounted for reciprocation in said head section between first and second positions;

a drive motor mounted in said head section and a gear train connected to and driven by said drive motor;

a handle section, supply line means in said handle section connected to said motor for supplying operating energy to said motor, and actuation means connected in said supply line means and including an actuator extending through said handle section for operation by an operator; and drive coupling means mounted in said head section and coupled between said gear train and said hammer head, said drive coupling measn including a cam and cam follower arrangement for moving said hammer head in a first direction and a spring engaging said hammer head to store energy during movement of said hammer head in said first direction and to release the stored energy when said hammer head reaches its first pposition and drive the hammer head in the second direction, said cam and cam follower arrangement comprising a cam mounted for rotation by said gear train, said cam including circumferentially-spaced lobes and a peripheral groove, and a cam follower mounted on said hammer head and shaped complemental and biased by said spring to be received in said groove.

2. The hand-held hammer of claim 1, wherein:

said drive motor comprises an air motor;

said supply line means comprises a compressed air line; and said actuation means comprises a valve.

3. The hand-held hammer of claim 1, wherein:

said drive motor is an a.c. motor;

said supply line means comprises a pair of conductors for connection to a commercial a.c. supply; and said actuation means comprises a switch connected in at least one of said conductors.

4. The hand-held hammer of claim 1, and further comprising:

a rechargeable battery mounted in said handle section; and wherein said drive motor comprises a d.c. motor;

said supply line means comprises a pair of conductors connected between said d.c. motor and said battery; and said actuation means comprises a switch connected in at least one of said conductors.

5. The hand-held hammer of claim 1, and further comprising:

a nail-pulling claw mounted on said head section.

6. The hand-held hammer of claim 1, wherein:

said hammer head comprises a striking head, and an intermediate member carrying said spring and connecting said striking head to said cam follower; and said head section comprises a chamber receiving said spring and said intermediate member.

7. A hand-held hammer comprising:

a head section and a hammer head mounted for reciprocation in said head section between first and second positions;

a drive motor mounted in said head section and a gear train connected to and driven by said drive motor;

a handle section, supply line means in said handle section connected to said motor for supplying operating energy to said motor, and actuation means connection in said supply line means and including an actuator extending through said handle section for operation by an operator;

drive coupling means mounted to said head section and coupled between said gear train and said hammer head, said drive coupling means including a cam and cam follower arrangement for moving said hammer head in a first direction and a spring engaging said hammer head to store energy during movement of said hammer head in said first direction and to release the stored energy when said hammer head reaches its first position and drive the hammer head in the second direction; and said cam and cam follower arrangement comprising a cam element mounted for rotation by said gear train, said cam element including an eccentric cam groove having a bell-shaped entry and a cam follower mounted on said hammer head to be cyclically received in and guided by said bell-shaped entry into said cam groove and cylically passing out of said cam groove.

8. The hand-held hammer of claim 7, wherein:

said hammer head comprises a striking head, and an intermediate member carrying said spring and connecting said striking head to said cam follower; and said head section comprises a chamber receiving said spring and said intermediate member.

9. The hand-held hammer of claim 8, wherein:

intermediate member comprises a guide slot and said head section comprises a guide pin extending through said guide slot.

10. A hand-held hammer comprising:

a head section and a hammer head mounted for reciprocation in said head section between first and second positions;

a drive motor mounted in said head section and a gear train connected to and driven by said drive motor;

a handle section, supply line means in said handle section connected to said motor for supplying operating energy to said motor, and actuation means connected in said supply line means and including an actuator extending through said handle section for operation by an opertor;

drive coupling means mounted in said head section and coupled between said gear train and said hammer head, said drive coupling means including a cam and cam follower arrangement for moving sid hammer head in a first direction and a spring engaging said hammer head to store energy during movement of said hammer head in said first direction and to relese the stored energy when said hammer head reaches its first position and drive the hammer head in the second direction;

said cam and cam follower arrangement comprising a cam mounted for rotation by said gear train, said cam including circumferentially-spaced lobes and a peripheral groove, and a cam follower mounted on said hammer head and shaped complementary to and biased by said spring to be received in said groove;

said hammer head comprising a striking head and an intermediate member carrying said spring and connecting said striking head to said cam follower, said head section comprising a chamber receiving said spring and said intermediate member; and said intermediate member comprising a guide slot and said head section comprising a guide pin extending through said guide slot.

11. A hand-held hammer comprising:

a head section and a hammer head mounted for reciprocation in said head section between first and second positions;

a drive motor mounted in said head section and a gear train connected to and driven by said drive motor;

a handle section, supply line means in said handle section connected to said motor for supplying operating energy to said motor, and actuation means connected in said supply line means and including an actuator extending through said handle section for operation by an operator; and drive coupling means mounted in said head section and coupled between said gear train and said hammer head, said drive coupling means including a cam and cam follower arrangement for moving said hammer head in a first direction and a spring engaging said hammer head to store energy during movement of said hammer head in said first direction and to release the stored energy when said hammer head reaches its first position and drive the hammer head in the second direction, said cam and cam follower arrangement comprising a cam element mounted for rotation by said gear train, said cam element including an eccentric cam groove having a bell-shaped entry, and a cam follower mounted on said hammer head to be cyclically received in and guided by said bell-shaped entry into said cam groove and cyclically passing out of said cam groove.

* * * * *